US011802679B2

(12) United States Patent
Liu

(10) Patent No.: US 11,802,679 B2
(45) Date of Patent: Oct. 31, 2023

(54) LAMP MOUNTING AND SUSPENDING PARTS

(71) Applicant: BRAVOLED INDUSTRIAL COMAPNY LIMITED, Shenzhen (CN)

(72) Inventor: Ziang Liu, Shenzhen (CN)

( * ) Notice: Subject to any disclaimer, the term of this patent is extended or adjusted under 35 U.S.C. 154(b) by 0 days.

(21) Appl. No.: 17/070,859

(22) Filed: Oct. 14, 2020

(65) Prior Publication Data

US 2022/0113009 A1 Apr. 14, 2022

(51) Int. Cl.

| | |
|---|---|
| ***F21V 21/00*** | (2006.01) |
| ***F21V 23/00*** | (2015.01) |
| ***F21V 21/03*** | (2006.01) |
| ***F21S 8/04*** | (2006.01) |

(52) U.S. Cl.

CPC ..... *F21V 21/00* (2013.01); *F21S 8/043* (2013.01); *F21V 21/03* (2013.01); *F21V 23/002* (2013.01)

(58) Field of Classification Search

CPC ..... F21V 21/00; F21V 21/02; F21V 21/03; F21V 21/044; F21V 21/045; F21S 8/043

See application file for complete search history.

(56) References Cited

U.S. PATENT DOCUMENTS

| | | | | |
|---|---|---|---|---|
| 2013/0051078 | A1* | 2/2013 | Kotera | F21V 23/006 362/631 |
| 2018/0003366 | A1* | 1/2018 | Halliwell | F21V 21/0832 |
| 2018/0003367 | A1* | 1/2018 | Halliwell | F21V 21/02 |
| 2018/0031212 | A1* | 2/2018 | Nguyen | F21S 8/026 |
| 2018/0045880 | A1* | 2/2018 | Boulanger | G02B 6/0051 |
| 2018/0299085 | A1* | 10/2018 | Xie | F21S 8/04 |
| 2019/0064429 | A1* | 2/2019 | Boulanger | F21V 21/03 |

* cited by examiner

*Primary Examiner* — Alexander K Garlen

(57) ABSTRACT

A lamp includes a mounting part configured to be capable of being mounted on a fixture, a lamp part, and two locking parts arranged on the lamp part. The mounting part includes two locking portions and each of the two locking portions have two first fastening elements arranged on two opposite ends thereof. Each of the locking part defines two slot assemblies corresponding to the first fastening elements. Each of the slot assemblies comprises a first slot, a second slot communicates with the first slot, and a third slot adjacent to the second slot. The lamp part is configured to be capable of moving between a first position where the first fastening elements are received in the first slots and a second position where the first fastening elements are received in the second slots while the ends of the first fastening elements enters the third slots.

17 Claims, 7 Drawing Sheets

LAMP MOUNTING AND SUSPENDING PARTS

FIELD OF THE INVENTION

The subject matter herein relates to a lamp.

BACKGROUND OF THE INVENTION

In general, when mounting a lamp onto a fixture, it is needed to connect wires between the fixture and the lamp and mount the lamp onto the fixture. It is difficult and time-consuming due to the large volume and weight of the lamp.

BRIEF DESCRIPTION OF THE DRAWINGS

Implementations of the present disclosure will now be described, by way of embodiment, with reference to the attached figures, wherein.

DETAILED DESCRIPTION OF THE ILLUSTRATED EMBODIMENT

The embodiment of the present disclosure will be described clearly and completely below in combination with the accompanying drawings. Obviously, the described embodiment is only one part of several embodiments of the present disclosure, not all of the embodiments. Based upon the embodiment of the present disclosure, all other embodiments obtained by those skilled in the art without creative labor belong to the protection scope of the present application.

It should be noted that if a component is called "fixed" to another component, it can be directly or indirectly fixed to another component or indirectly fixed to another component by an intermediate component. If a component is considered to "connect" to another component, it can be directly connected to another component or indirectly connected to another component by an intermediate component. When a component is considered to be "arranged" on another component, it can be set directly to another component or indirectly arranged on another component by an intermediate component. The terms "vertical", "horizontal", "left", "right" and similar expressions indicating directions or positions are based on the directions or positions shown in the attached drawings in order to facilitate the description of the embodiment and simplify the description of the invention, rather than indicating or implying that the device or element referred to must have a specific orientation, be constructed and operated in a specific orientation, it cannot be understood as a limitation of the embodiment of the invention.

Unless otherwise defined, all technical and scientific terms used in the present disclosure have the same meanings as those generally understood by those skilled in the technical field of the application. The terms used in the specification of the present application are only for the purpose of description, and are not intended to limit the present application. The term "or/and" used in the present disclosure includes any one of and all combinations of two or more related listed items.

Some embodiments of the present disclosure are described in detail below in combination with the attached drawings. Without conflict, the following embodiments and features in the embodiments may be combined with each other.

Figure 1:
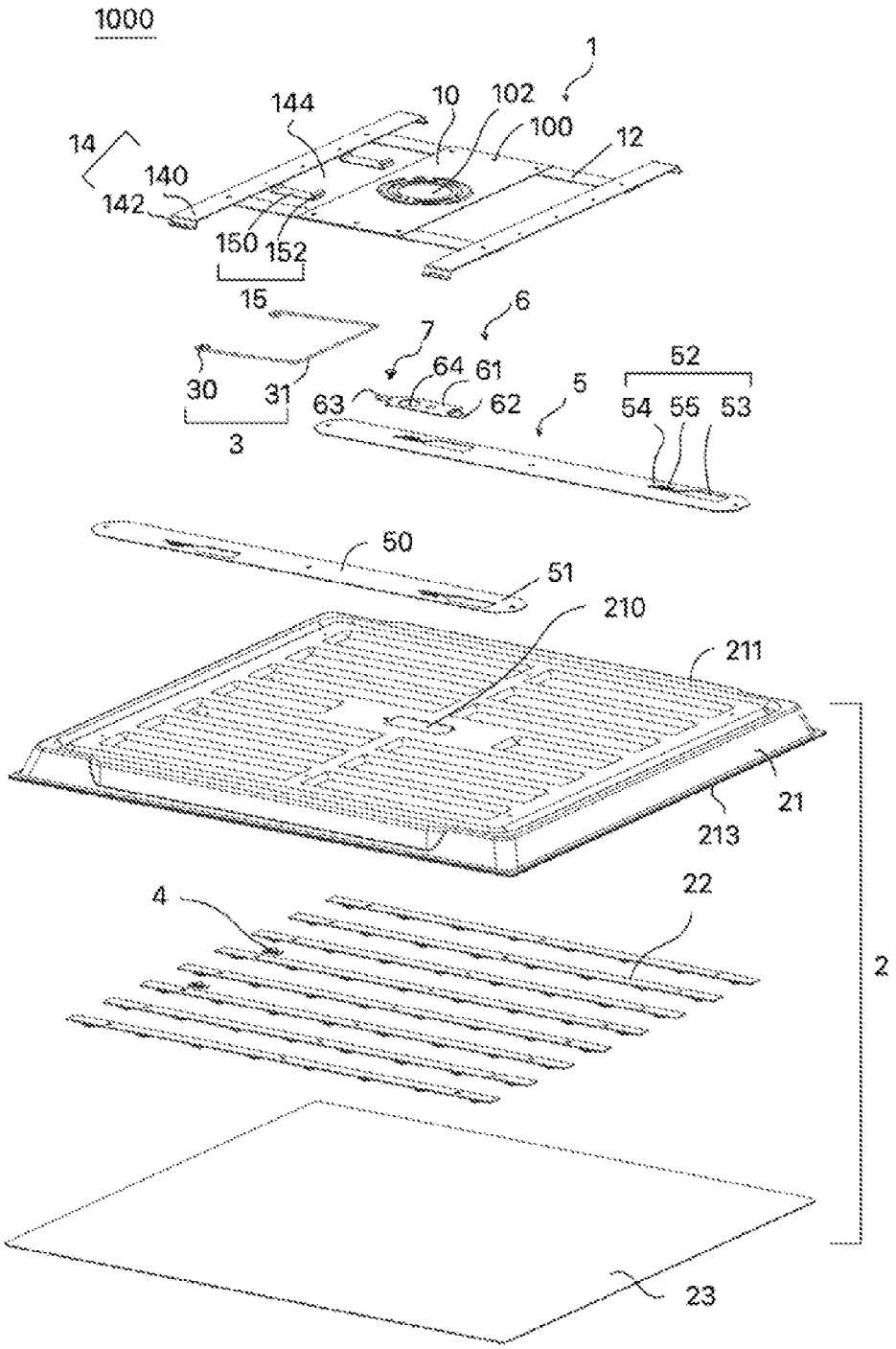
FIG. 1 is an exploded view of a lamp according to an embodiment of the present disclosure, the lamp including a mounting part, a lamp part, and a suspension part.

Referring to FIG. 1, a lamp 1000 of the present disclosure is provided. The lamp 1000 includes a mounting part 1, a lamp part 2, and a suspension part 3. The mounting part 1 is configured to be mounted onto a fixture, such as a wall. The suspension part 3 can be fixed on the lamp part 2 and suspended from the mounting part 1 so as to have the lamp part 3 to be suspended from the mounting part 1, thereby facilitating wire connections between the fixture and the lamp part 3.

The mounting part 1 can include a fixing portion 10, two connecting portions 12, two locking portions 14, and two first suspension portions 15. The fixing portion 10 is configured to be mounted onto the fixture. The fixing portion 10 defines a plurality of mounting holes 100 which allows screws to pass through so as to mount the fixing portion 10 onto the fixture. The fixing portion 10 further defines a first opening 102 which allows wires to pass through to facilitate wire connections between the fixture and the lamp part 2. The two connecting portions 12 are arranged on two opposite sides of the fixing portion 10. Each connecting portion 12 has two opposite ends extending out from the fixing part 10. The two locking portions 14 are arranged at distal ends of the two connecting portions 12. The two locking portions together with the two connecting portions 12 form a substantially rectangular frame. The fixing portion 10 is arranged on the rectangular frame. A length of each connecting portion 12 is greater than a length of a side of the fixing portion 10 where the connecting portion 12 is arranged. Therefore, there is a gap 144 defined between the fixing portion 10 and the locking portion 14. Each of the two first suspension portion 15 extends from one of the two locking portions 14 towards the fixing portion 10. That is, the two first suspension portions 15 are located in the gap 144.

Each of the locking portion 14 includes a mounting board 140 and two first fastening elements 142 arranged at two opposite ends of the mounting board 140. The mounting board 140 can be mounted onto the fixture by fixing elements such as screws.

Each of the first suspension portion 15 includes a blocking element 152 and a guiding plate 150 connecting between the locking portion 14 and the blocking element 152.

The lamp par 2 includes a bottom case 21, a lamp body 22, and a lamp cover 23. The lamp cover 23 can be mounted on the bottom case 21 to form a receiving space for receiving the lamp body 22.

The bottom case 21 defines a second opening 210 corresponding to the first opening 102, which allows wires to pass through to facilitate wire connections between the lamp body 22 and the fixture. The bottom case 21 includes a first side 211 and a second side 213 away from the first side 211. The first side 211 faces the mounting part 1 while the second side 213 faces the lamp body 23.

The suspension part 3 includes a second suspension portion 31 and two positioning portions 30 arranged at two opposites ends of the second suspension portion 31. The second suspension portion 31*s* can be configured to be hang from the first suspension portions 15. In the illustrated embodiment, the second suspension portion 31 is substantially in a U shape. A width of the second suspension portion 31 is greater than a distance between the two first suspension portions 15. The second suspension portion 31 can slide along the guiding plate 150.

The suspension part 3 can be fixed on the bottom case 21 through two position parts 4. The two position parts 4 are configured to be placed on the two positioning portions 30 to fix the two positioning portions 30 onto the bottom case 21.

The lamp 1000 further includes two locking parts 5 configured to be fixed on the bottom case 21 and cooperate with the locking portions 14 of the mounting part 1 to fix the lamp part 2 onto the mounting part 1.

Each of the locking parts 5 includes a mounting plate 50. The mounting plate 50 defines a plurality of fixing holes 51 which allows fixing elements like screws to pass through to fix the mounting plate 50 onto the bottom case 21. The mounting plate 50 mounted on the first side 211 of the lamp part 2.

Each of the locking parts 5 defines two fastening slot assemblies 52 corresponding to two first fastening elements 142 respectively. Each of the fastening slot assemblies 52 includes a first slot 53, a second slot 54 communicating with the first slot 53, and a third slot 55 adjacent to the second slot 54. A width of each second slot 54 is less than that of each first slot 53. The first fastening elements 142 can slide from the first slot 53 to the second slot 54, and a distal end of the first fastening elements 142 can enter the third slot 55 so as to lock the mounting part 7 onto the locking parts 5.

The lamp 1000 further includes a flexible plate 6. The flexible plate 6 is arranged on the bottom case 21 and configured to be deformed under extra force applied thereon. When the lamp part 2 is mounted on the mounting part 1, the flexible plate 6 resists against the mounting part 1 to keep the first fastening elements 142 in the third slot 55. When the lamp part 1 is applied an extra force, the flexible plate 6 is deformed to allow the first fastening elements 142 out from the third slot 55. Thus, the first fastening elements 142 can slide from the second slot 54 to the first slot 53 to be separate from the locking part 5.

The flexible plate 6 includes a main body 61, a first flexible end 62 and a second flexible end 63 arranged at two opposite ends of the main body 61. The main body 61 can be fixed onto the bottom case 21 by fixing elements 7. The main body 61 defines a third opening 64 corresponding to the first opening 102 of the mounting part 1 and the second opening 210 of the bottom case 21, which allows wires of the lamp body 22 to pass through to connect wires on the fixture. The first flexible end 62 extends towards the bottom case 21 to form a first sloping structure. The second flexible end 63 extends towards the mounting part 1 to form a second sloping structure.

When mounting the lamp 1000, the lamp body 22 is mounted inside the bottom case 21 and then the lamp cover 23 is connected to the bottom cover 21 to enclose the lamp body 22. The mounting part 1 is fixed onto the fixture, such as a wall, and then the lamp part 2 is mounted onto the mounting part 1.

Figure 2:
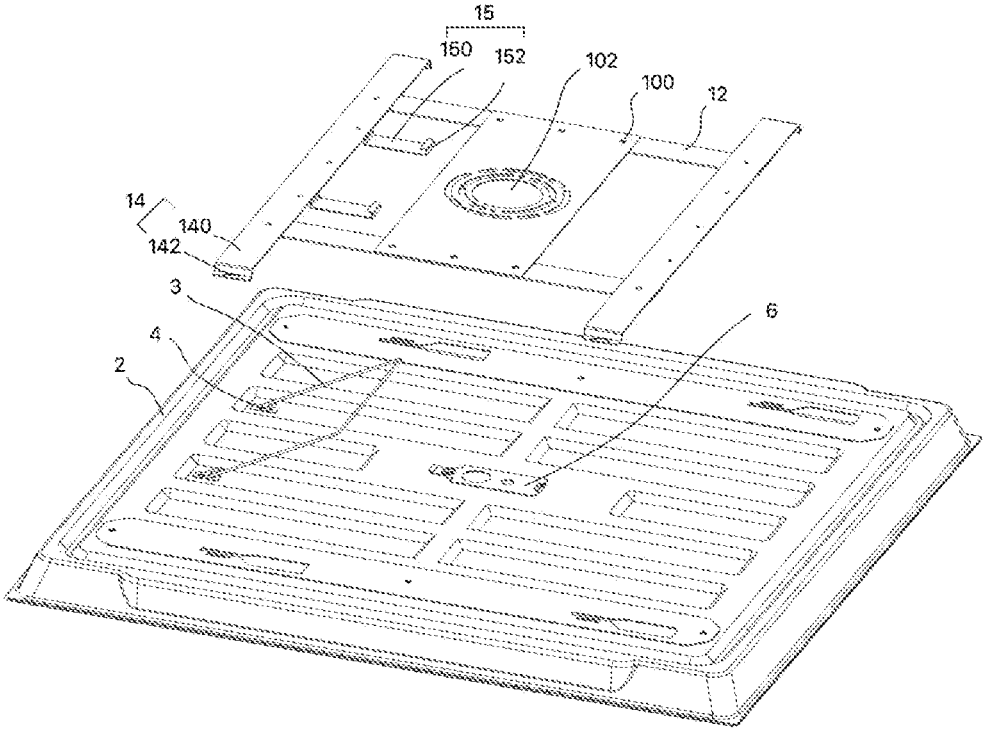
FIG. 2 is a schematic diagram of the lamp of FIG. 1, with the suspension part being fixed upon the lamp part.
Figure 3:
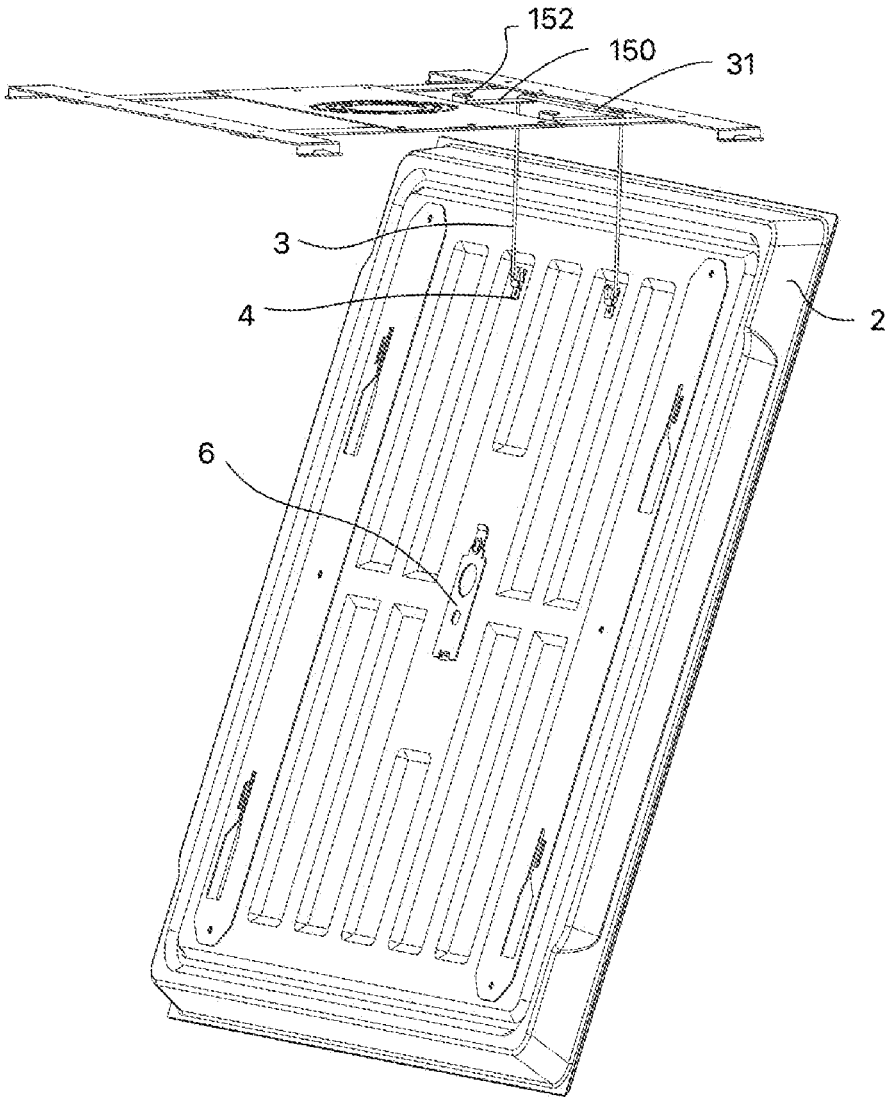
FIG. 3 is a schematic diagram of the lamp of FIG. 1, with the suspension part being suspended from the mounting part.

Referring to FIGS. 2-5, before the lamp part 2 being mounted onto the mounting part 1, the flexible plate 6 is fixed onto the bottom case 21. Then, the suspension part 3 is fixed on the bottom case 21 through the positioning part 4 (as illustrated in FIG. 2). Next, the suspension part 3 is hang from the suspension portions 15 (as illustrated in FIG. 3). At this time, the lamp part 2 hangs from the mounting part 1 by the suspension part 3, which facilitate wire connections between the lamp part 2 and the fixture.

Figure 4:
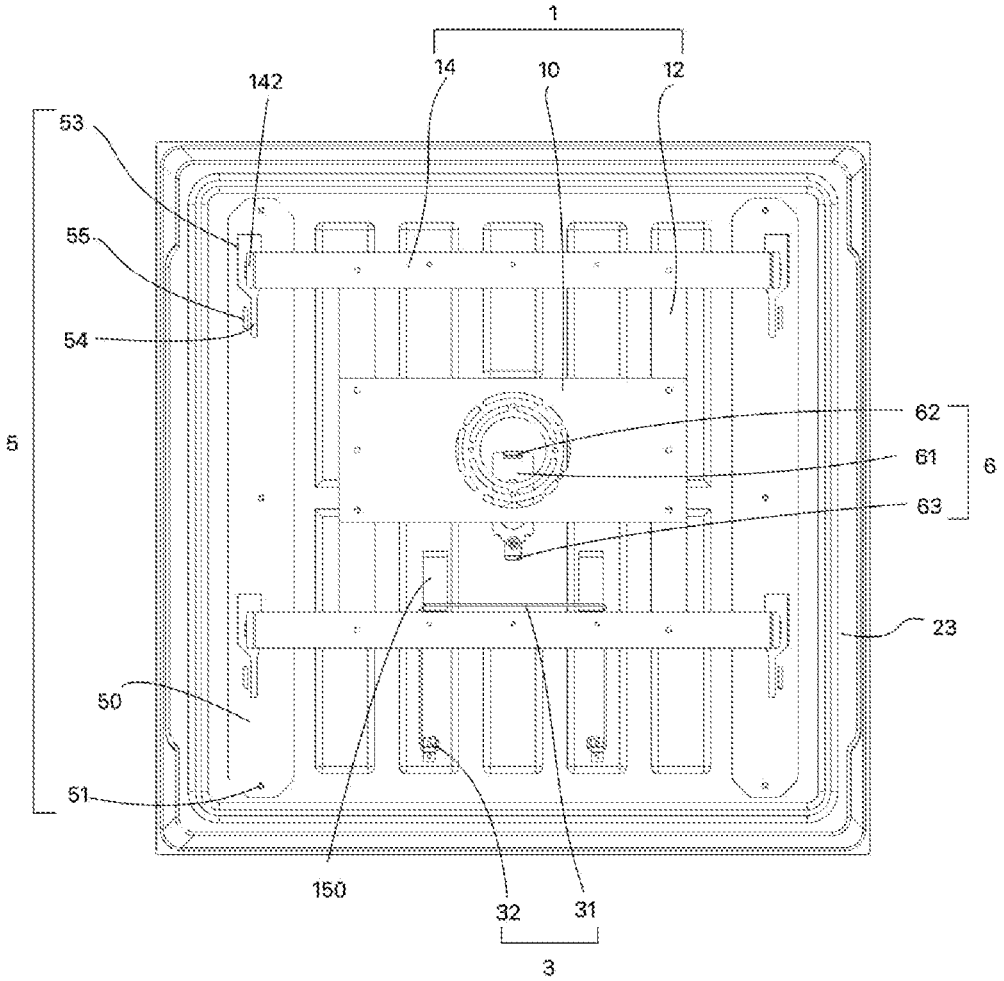
FIG. 4 is a schematic diagram of the lamp of FIG. 1, with the lamp part close to the mounting part.
Figure 5:
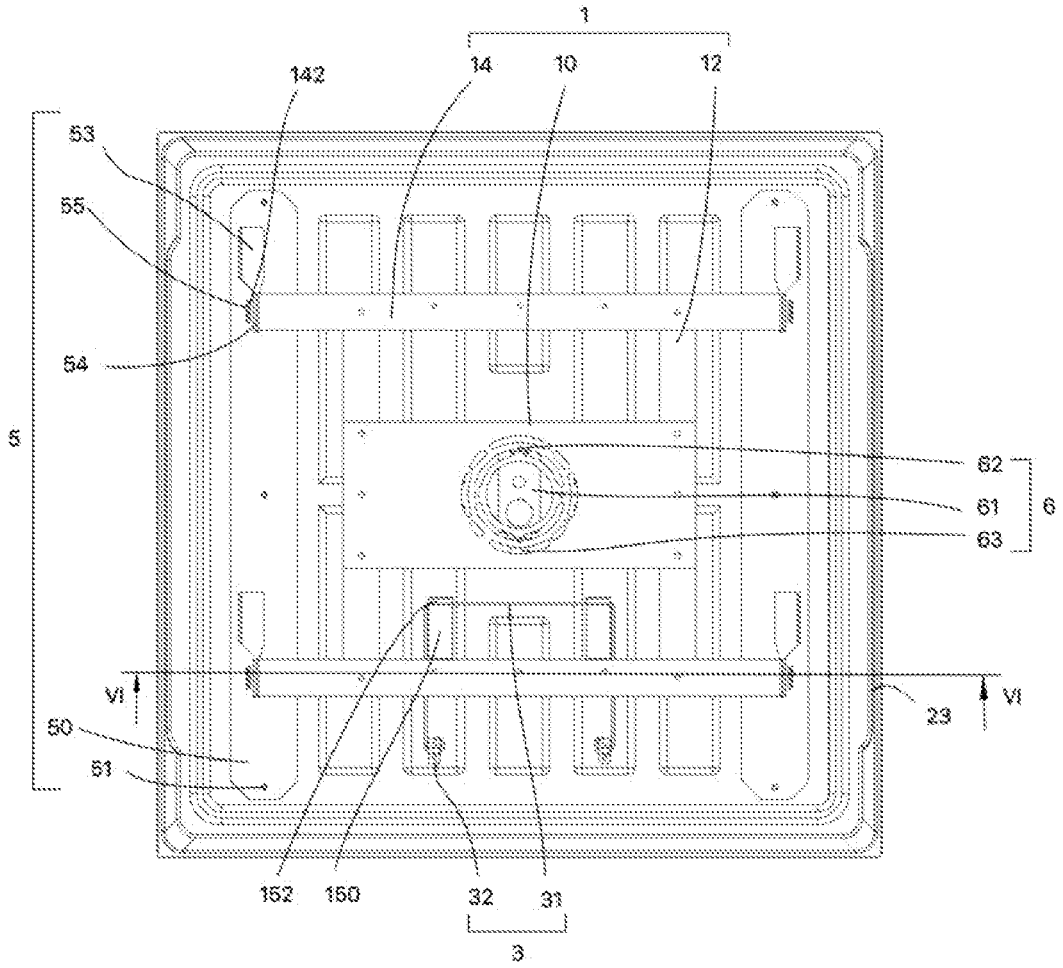
FIG. 5 is a schematic diagram of the lamp of FIG. 1, with the lamp part being fixed upon the mounting part.

After the wire connection is done, the lamp part 2 can be pushed towards the mounting part 1. Referring to FIGS. 4 and 5, the suspension part 3 guides the lamp part 2 to be pushed to a first position where the first fastening elements 142 of the two locking portions 14 are received in the first slots 53 (as illustrated in FIG. 4). The mounting part 1 can be pushed along a first direction in which the locking parts 8 extends. The second suspension portion 31 sliding along the guiding plate 150 helps to guide the mounting part 1 to move along the first direction. The mounting part 1 is pushed along the first direction to slide from the first position to the second position where the ends of the fastening elements 142 enter the third slots 55 respectively (as illustrated in FIG. 5). The second suspension portion 31 resists against the blocking element 152. Thus, the mounting part 1 cannot move relative to the locking parts 8, and the lamp part 2 is fixed onto the mounting part 1.

The flexible plate 6 extends along the first direction. Along sliding of the mounting part 1 along the first direction, the fixing portion 10 moves from the first flexible end 62 to the second flexible end 63. The first sloping structure facilitates moving of the fixing portion 10 along the first direction. When the lamp part 1 is pushed to have the first fastening elements 142 slides from the first slots 53 into the second slots 54, the fixing portion 10 resists against the flexible plate 6 and the second flexible end 63 is deformed under a pressure of the fixing portion 10 until the ends of the first fastening elements 142 enters the third slots 55. When a force applied on the lamp part 1 is released, the second flexible ends 63 is restored to resists the fixing portion 10, thereby making the first fastening elements 142 firmly received in the third slots 54.

When a user want to demount the lamp part 2 off from the mounting part 1, a force perpendicular to the lamp part 2 can be applied to have the flexible plate 6 deformed and then a push force along a second direction contrary to the first direction can be applied on the lamp part 2 to push the first fastening elements 142 slide from the second position to the first position. Thus, the lamp part 1 can be easily taken off the mounting part 1.

Figure 6:
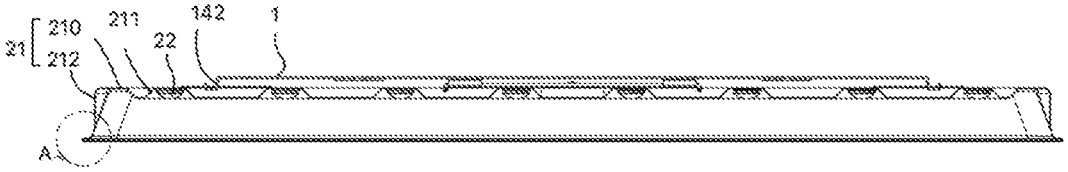
FIG. 6 is a sectional view of the lamp of FIG. 5 taken along line VI-VI of FIG. 5.
Figure 7:
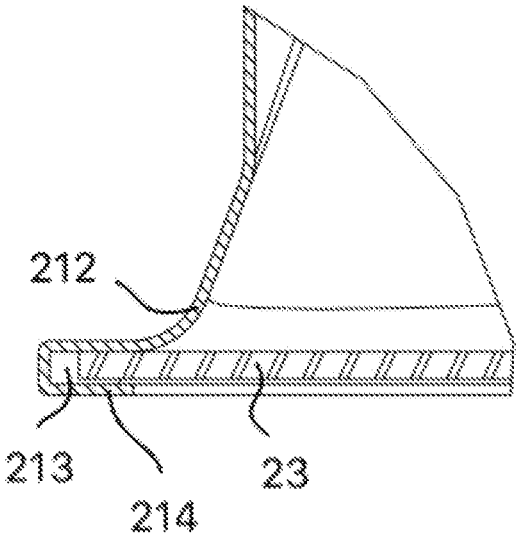
FIG. 7 is an enlarged view of a part A of FIG. 6.

Referring to FIGS. 6 and 7, the bottom case 21 includes a top wall 210 and a sidewall 212 extending from the top wall 210 to define a receiving recess 211 and the lamp body 22 can be mounted in the receiving recess 211. The bottom case 21 further forms a turned edge 214 at an end of the side wall 212 away from the top wall 210. The bottom case 21 is integrally formed. The turned edge 214 together with the side wall 212 defines a mounting groove 213 for mounting the lamp cover 23. The lamp cover 23 can be pushed to be deformed so that the lamp cover 23 can be inserted into the mounting groove 213. In at least one embodiment, the lamp cover 23 can be further fixed into the mounting groove 213 by adhesive layers. Therefore, the lamp cover 23 can be easily mounted on the bottom case 21 without extra tools. In at least one embodiment, a width of the turned edge 214 (along a radius of the lamp cover 23) is less than 5 mm. When the lamp is assembled and lighted on, the turned edge 214 is inconspicuous, thereby improving overall aesthetic feeling of the product.

In at least one embodiment, the locking parts 8 can be integrally formed with the bottom case 21.

In the present disclosure, the lamp part 2 and the mounting part 1 are arranged separately. The mounting part 1 can be firstly mounted on the fixture such as a wall easily. The lamp part 2 can be hung from the mounting part 1 through the suspension part 3 to facilitate wire connections between the lamp part 2 and the fixture. The locking portions 14 of the mounting part 1 can cooperate with the locking parts 5 to lock or unlock the lamp part 2 on the mounting part 1.

Mounting or dismounting of the lamp part 2 is simple and easy to operate, which can be finished by one person himself. It is time saving and cost saving.

It can be understood that ordinary person skilled in the art can make various other corresponding changes and deformations according to the technical concept of the present disclosure, and all such changes and deformations shall belong to the protection scope of the present application.

What is claimed, and is desired to be protected by Letters Patent is:

1. A lamp, comprising:

a mounting part, configured to be capable of being mounted on a fixture;

a lamp part; and two locking parts, arranged on the lamp part, configured to cooperate with the mounting part to lock the lamp part on the mounting part wherein the mounting part comprises two locking portions and each of the two locking portions has two first fastening elements arranged on two opposite ends thereof; each of the locking parts define two slot assemblies corresponding to the first fastening elements, each of the slot assemblies comprise a first slot, a second slot which communicates with the first slot, and a third slot adjacent to the second slot, the lamp part is configured to be capable of moving between a first position where the first fastening elements are received in the first slots and a second position where the first fastening elements are received in the second slots while the ends of the first fastening elements enter the third slots;

wherein the lamp part comprises a bottom case and a lamp cover configured to be mounted on the bottom case;

wherein the mounting part comprises a fixing portion configured to be mounted on the fixture, the two locking portions are arranged at two opposite sides of the fixing portion; and a flexible olate is arranged on the bottom case, the flexible plate is deformed under a pressure of the fixing portion when the lamp part is pushed to move between the first position and the second position, and restored to resist against the fixing portion to keen the first fastening elements in the third slots.

2. The lamp according to claim 1, wherein a width of each second slot is less than that of each first slot.

3. The lamp according to claim 1, wherein when the lamp part is at the second position, the flexible plate is configured to be deformed under an extra force to have the first fastening element quit from the third slot.

4. The lamp according to claim 1, wherein the flexible plate comprises a first flexible end forming a sloping structure which facilitates moving of the lamp part relative to the mounting part.

5. The lamp according to claim 1, further comprises a suspension part, wherein two suspension portions extend from one of the locking portions towards the fixing portion, one end of the suspension part is fixed on the bottom case, and the other end of the suspension part is hung from two suspension portions.

6. The lamp according to claim 5, wherein each of the two suspension portions comprises a guiding plate extending from the one of the two locking portions and a blocking element arranged at a distal end of the guiding plate.

7. The lamp according to claim 6, wherein the suspension part is in a U shape, and is configured to capable of sliding along the guiding plate during moving of the lamp part between the first position and the second position.

8. The lamp according to claim 7, wherein the blocking element resists against the suspension part at the second position.

9. The lamp according to claim 1, wherein the fixing portion defines a first opening, the bottom case defines a second opening corresponding to the first opening, which allows wires of a lamp body mounted in the bottom case to pass through to connect wires on the fixture.

10. The lamp according to claim 1, wherein the two locking parts are integrally formed on the bottom case.

11. The lamp according to claim 1, wherein the mounting part comprises two connecting portions arranged at two opposite sides of the fixing portion where the two locking portions are not arranged, the two locking portions connects the two connecting portions to form a rectangular frame.

12. The lamp according to claim 11, wherein the fixing portion is arranged on the frame, and a gap is defined between the fixing portion and each of the two locking portions, the suspension portion extends in the gap.

13. The lamp according to claim 1, wherein each of the first fastening elements is in a U shape.

14. The lamp according to claim 5, wherein the suspension part comprises two positioning portions arranged on two opposite distal ends thereof and configured to be mounted on the bottom case, and the positioning portions are locked on the bottom case by two positioning elements respectively.

15. The lamp according to claim 1, wherein the bottom case includes a top wall and a sidewall, the top wall and the sidewall define a receiving recess for receiving a lamp body.

16. The lamp according to claim 1, wherein the bottom case forms a turned edge at an end of the sidewall away from the top wall, the turned edge together with the sidewall defines a mounting groove for mounting the lamp cover.

17. The lamp according to claim 16, wherein a width of the turned edge is less than 5 mm.

* * * * *